US010737317B2

(12) United States Patent
Tsutsumi et al.

(10) Patent No.: US 10,737,317 B2
(45) Date of Patent: Aug. 11, 2020

(54) CORE MOLDING METHOD AND CORE MOLDING DEVICE

(71) Applicant: KABUSHIKI KAISHA KOBE SEIKO SHO, Hyogo (JP)

(72) Inventors: Kazuyuki Tsutsumi, Hyogo (JP); Yusaku Takagawa, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 214 days.

(21) Appl. No.: 16/060,129

(22) PCT Filed: Dec. 5, 2016

(86) PCT No.: PCT/JP2016/086089
§ 371 (c)(1),
(2) Date: Jun. 7, 2018

(87) PCT Pub. No.: WO2017/099040
PCT Pub. Date: Jun. 15, 2017

(65) Prior Publication Data

US 2018/0361468 A1 Dec. 20, 2018

(30) Foreign Application Priority Data

May 17, 2016 (JP) ..... 2016-098736

(51) Int. Cl.
*B22C 17/00* (2006.01)
*B22C 13/12* (2006.01)
(Continued)

(52) U.S. Cl.
CPC ..... *B22C 17/00* (2013.01); *B22C 7/06* (2013.01); *B22C 9/02* (2013.01); *B22C 9/10* (2013.01); *B22C 13/12* (2013.01); *B22C 19/06* (2013.01)

(58) Field of Classification Search
CPC B22C 13/12; B22C 17/00; B22C 7/06; B22C 9/02; B22C 9/10; B22C 9/22; B22C 19/06
See application file for complete search history.

(56) References Cited

U.S. PATENT DOCUMENTS

2015/0231692 A1* 8/2015 Tsutsumi ..... B22C 9/22 164/349
2016/0303645 A1 10/2016 Tsutsumi et al.

FOREIGN PATENT DOCUMENTS

CN 102909321 A 2/2013
EP 0212459 A2 3/1987
(Continued)

OTHER PUBLICATIONS

International Search Report; issued in PCT/JP2016/086089; dated Feb. 28, 2017.

*Primary Examiner* — Kevin E Yoon
(74) *Attorney, Agent, or Firm* — Studebaker & Brackett PC

(57) ABSTRACT

A core molding method for molding a core having a twisted shape by use of a core mold includes a curing step and a mold extracting step. In the curing step, after the core mold is disposed along a vertical direction within a frame whose top is open, a self-hardening sand formed of a kneaded mixture of a sand, a resin and a curing agent is charged into the frame from the top of the frame, and then cured. In the mold extracting step, the core mold is extracted in the vertical direction from the core formed of the cured self-hardening sand while rotating the core mold and the frame relatively to each other around an axis of the core mold.

6 Claims, 8 Drawing Sheets

(51) Int. Cl.

| | |
|---|---|
| ***B22C 7/06*** | (2006.01) |
| ***B22C 9/10*** | (2006.01) |
| ***B22C 19/06*** | (2006.01) |
| ***B22C 9/02*** | (2006.01) |

(56) References Cited

FOREIGN PATENT DOCUMENTS

| | | | |
|---|---|---|---|
| GB | 1164303 | A | 9/1969 |
| JP | 2015-128791 | A | 7/2015 |

* cited by examiner

CORE MOLDING METHOD AND CORE MOLDING DEVICE

TECHNICAL FIELD

The present invention relates to a core molding method and a core molding apparatus, in which a core (sand mold) having a complicated shape required for casting a product having a twisted shape, such as a male rotor or a female rotor in a screw compressor, is molded by use of a core mold.

BACKGROUND ART

A product having a twisted shape, such as a male rotor or a female rotor in a screw compressor, is manufactured by a method in which a casting formed in a near net shape (a shape close to a final product shape due to a reduced machining margin) is produced by casting, and finished.

Patent Literature 1 discloses a core molding method for molding a core required for producing a casting formed in a near net shape by use of a core mold. In Patent Literature 1, the core mold is extracted in a horizontal direction from the core formed of a cured self-hardening sand while rotating the core mold disposed along a horizontal direction within a frame around its axis.

CITATION LIST

Patent Literature

Patent Literature 1: JP-A-2015-128791

SUMMARY OF THE INVENTION

Technical Problems

However, there is a problem in Patent Literature 1 as follows. That is, when the core mold is disposed along a vertical direction within the frame and the frame is filled with the self-hardening sand from the top of the frame, the frame filled with the self-hardening sand must be laid flat. Thus, with increase in weight, workability deteriorates. In addition, the position of the frame laid flat must be adjusted to align the axis of the core mold with the axis of a motor for rotating the core mold. Thus, with increase in weight, workability deteriorates.

On the other hand, when the core mold is disposed along a horizontal direction within the frame and the frame is filled with the self-hardening sand from the side of the frame, it is not necessary to change the posture of the frame. Accordingly, the motor and the core mold can be aligned with each other axially in advance. However, when the frame is filled with the self-hardening sand from the side of the frame, it is difficult to charge the self-hardening sand to a valley portion of the core mold having a twisted shape. Thus, a failure in shape may appear easily in a core molded.

An object of the present invention is to provide a core molding method and core molding apparatus which are capable of molding a core having an excellent shape with improved workability.

Solution to Problems

In the core molding method for molding a core having a twisted shape by use of a core mold in the present invention, the core molding method includes: a curing step in which after the core mold is disposed along a vertical direction within a frame whose top is open, a self-hardening sand formed of a kneaded mixture of a sand, a resin and a curing agent is charged into the frame from the top of the frame, and then cured; and a mold extracting step in which the core mold is extracted in the vertical direction from the core formed of the cured self-hardening sand while rotating the core mold and the frame relatively to each other around an axis of the core mold.

In addition, in the core molding apparatus for molding a core having a twisted shape by use of a core mold in the present invention, the core molding apparatus includes: a frame whose top is open and in which the core mold is internally disposed along a vertical direction, the frame configured to be filled with a self-hardening sand formed of a kneaded mixture of a sand, a resin and a curing agent from the top of the frame, the self-hardening sand being subjected to curing; and a rotary driving unit which rotates the core mold and the frame relatively to each other around an axis of the core mold so that the core mold is extracted in the vertical direction from the core formed of the cured self-hardening sand.

Advantageous Effects of the Invention

In the present invention, a core mold is disposed along a vertical direction within a frame, and a self-hardening sand is then charged into the frame from the top of the frame, and cured. The core mold is extracted in the vertical direction from a core formed of the cured self-hardening sand. Since the core mold disposed along the vertical direction is extracted in the vertical direction, it is not necessary to change the posture of the frame. It is therefore possible to align a motor with the core mold axially in advance. Thus, workability can be improved. In addition, since the self-hardening sand are charged into the frame from the top of the frame, the self-hardening sand can be sufficiently charged into a valley portion of the core mold having a twisted shape. It is therefore possible to mold the core with an excellent shape.

DESCRIPTION OF EMBODIMENTS

Figure 1:
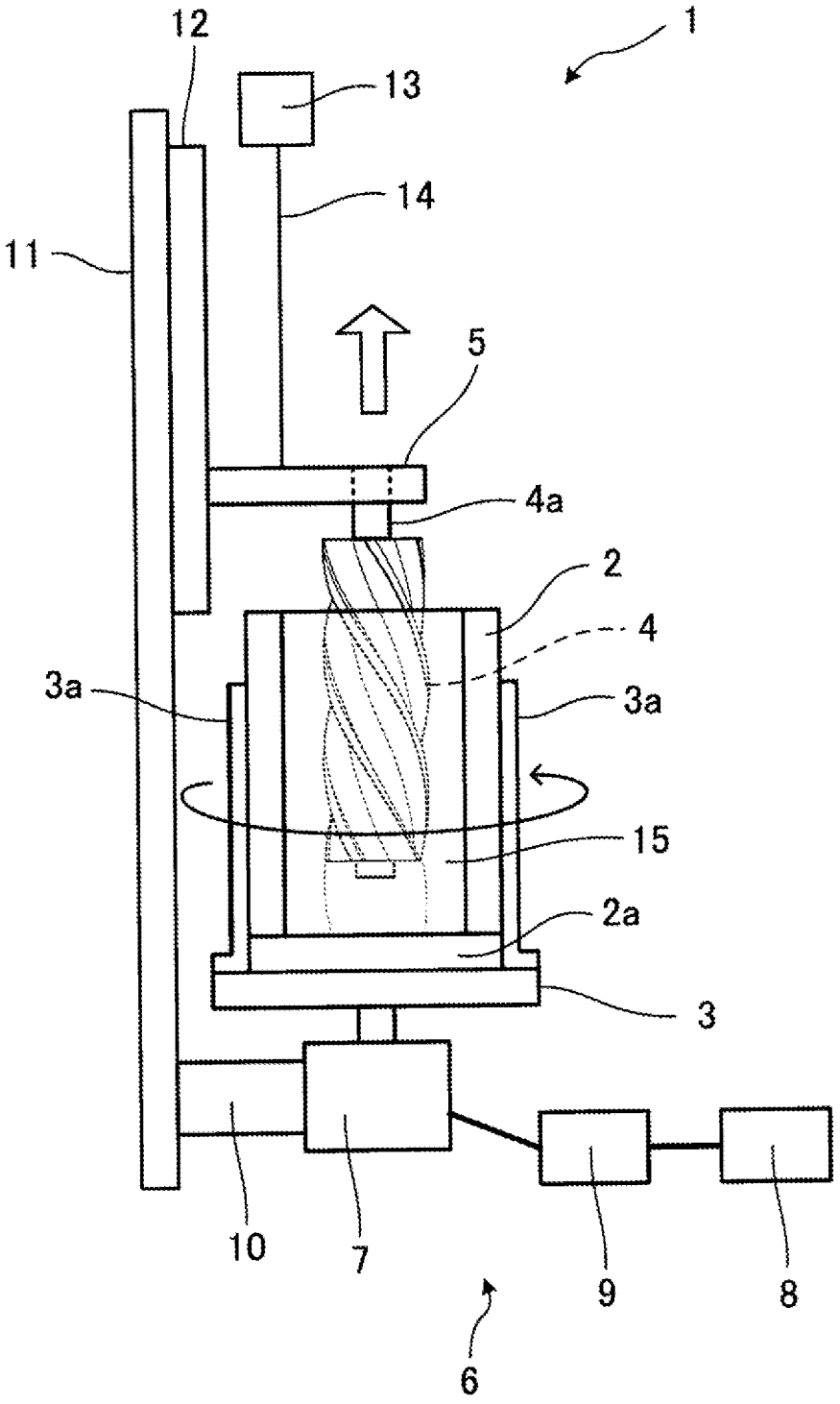
FIG. 1 A side view showing a configuration of a core molding apparatus.

Preferred embodiments of the present invention will be described below with reference to the drawings.

[First Embodiment]

(Core Molding Method)

A core molding method in the first embodiment of the present invention is a method in which a core (sand mold) having a complicated shape required for casting a product having a twisted shape, such as a male rotor or a female rotor in a screw compressor, is molded by use of a core mold. The core molding method includes a curing step and a mold extracting step.

(Curing Step)

The curing step is a step in which, after a core mold made of a wood, a metal or a resin and having a twisted shape is disposed within a frame, a self-hardening sand formed of a kneaded mixture of a sand, a resin and a curing agent is charged into the frame and cured.

In this embodiment, the core mold is disposed along a vertical direction within the frame whose top is open. Then, the self-hardening sand is charged into the frame from the top of the frame, and then cured.

The self-hardening sand is new sand or reborn sand whose grain shape is polygonal or spherical and whose grain size is 130 or less in AFS number. The resin used as a bonding agent in the self-hardening sand is an acid-curable furan resin containing furfuryl alcohol. The addition proportion of the resin to the sand is 0.8%. The curing agent used as a curing catalyst in the self-hardening sand is a curing agent for the furan resin. The curing agent is a mixture of a xylenesulfonic acid based curing agent and a sulfuric acid based curing agent. The addition proportion of the curing agent to the furan resin is 40%. When the sand, resin and curing agent are used in the self-hardening sand, the core can be suitably molded.

For the kneaded mixture of the sand, the resin and the curing agent, it is preferable that the sand and the curing agent are first kneaded, and the resin is then added thereto and the mixture is further kneaded. A general-purpose household mixer may be suitably used for the kneading. By the household mixer, the sand and the curing agent are kneaded for 45 seconds, and the resin is then added and further kneaded for 45 seconds. Thus, the self-hardening sand is obtained. The self-hardening sand is charged into the frame from the top of the frame. Inside the frame which is made of a wood, a metal or a resin, the core mold has been disposed along the vertical direction. On this occasion, the self-hardening sand is charged into the frame along the axial direction of the core mold while vibrating the self-hardening sand. Due to irreversible dehydration condensation reaction produced between the resin and the curing agent, the self-hardening sand is cured and contracted with time.

(Mold Extracting Step)

The mold extracting step is a step in which the core mold is extracted from the core formed of the self-hardening sand which has been cured, while rotating the core mold and the frame relatively to each other around the axis of the core mold. After a predetermined curing time has passed, the core mold and the frame are rotated relatively to each other around the axis of the core mold, so that the core mold is extracted in the vertical direction from the core. Here, the curing time is an elapsed time since the termination of the kneading among the sand, the resin and the curing agent.

In this embodiment, the core mold is fixed not to be rotated, and the frame is rotated in a horizontal direction. In addition, the frame is rotated in the horizontal direction while pulling the core mold in an upper direction with a tension not lower than a load of the core mold. When the frame is rotated in the horizontal direction, the core mold having a screw shape is extracted from the core along the vertical direction. On this occasion, the rotating direction of the frame is set so that the core mold can be extracted in the upper direction. Thus, the core mold is extracted in the upper direction from the core.

(Core Molding Apparatus)

In a core molding apparatus in the first embodiment of the present invention, the aforementioned core molding method is performed. The core molding apparatus 1 includes a frame 2 whose top is open and which is made of a wood, a metal or a resin, as shown in FIG. 1 which is a side view thereof. The frame 2 is mounted on a frame bed 3. Inside the frame 2, a core mold 4 having a screw shape is disposed along a vertical direction. A shaft 4*a* of the core mold 4 is unrotatably retained by a shaft retainer 5. The frame 2 is filled with a self-hardening sand from the top of the frame. The self-hardening sand is formed of a kneaded mixture of a sand, a resin and a curing agent.

Correspondingly to each of the four side surfaces of the frame 2, the frame bed 3 has side plates 3*a* which can move forward and backward in the horizontal direction relatively to the frame 2. When the side plates 3*a* are brought respectively into contact with the four side surfaces of the frame 2 mounted on the frame bed 3, the frame 2 is fixed onto the frame bed 3. On this occasion, the frame 2 is fixed onto the frame bed 3 so that the central axis of the frame 2 is aligned with the central axis of a motor 7 which will be described later.

The shaft retainer 5 which retains the shaft 4*a* of the core mold 4 is made movable in the vertical direction along a rail 12 laid on a side surface of a stand 11 along the vertical direction.

The core molding apparatus 1 also includes a rotary driving unit 6 which rotates the core mold 4 and the frame 2 relatively to each other around the axis of the core mold 4. The rotary driving unit 6 includes the motor 7, a power source 8 and an inverter 9. The motor 7 is fixed to the stand 11 through a motor fixture 10.

The motor 7 is electrically connected to the power source 8 through the inverter 9. The rotational speed of the motor 7 is adjusted by the inverter 9.

The core molding apparatus 1 also includes a pulling unit 13. The pulling unit 13 pulls and winds up a wire 14 connected to the shaft retainer 5. The pulling unit 13 pulls the shaft retainer 5 and hence the core mold 4 in the upper direction with a tension not lower than the load of the core mold 4. More specifically, the pulling unit 13 pulls the shaft retainer 5 in the upper direction with the tension equal to or higher than the total load of the core mold 4, the shaft retainer 5 and the wire 14. In this embodiment, the pulling unit 13 is a balancer.

The motor 7 rotates the frame bed 3 in the horizontal direction. Thus, the frame 2 fixed onto the frame bed 3 is rotated in the horizontal direction. Here, the rotating direction of the frame 2 is set so that the core mold 4 can be extracted in the upper direction from a core 15.

Figure 2:
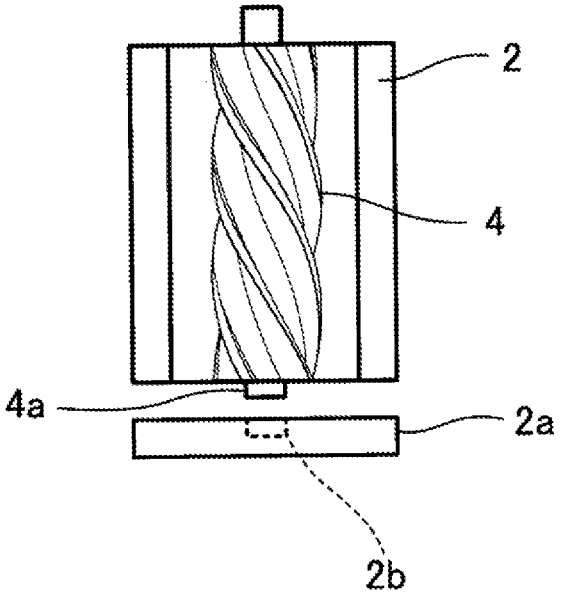
FIG. 2 A side view of a frame.

Here, as shown in FIG. 2 which is a side view of the frame 2, a columnar concave portion 2*b* to which the columnar shaft 4*a* of the core mold 4 can be fitted is provided in a bottom plate 2*a* of the frame 2. The shaft 4*a* of the core mold 4 and the concave portion 2*b* of the bottom plate 2*a* constitute an adjustment mechanism for aligning the central axis of the core mold 4 with the central axis of the frame 2. When the core mold 4 is disposed inside the frame 2, the shaft 4*a* of the core mold 4 is fitted into the concave portion 2*b*. Thus, the central axis of the core mold 4 is aligned with the central axis of the frame 2. Accordingly, when the frame 2 is rotated in the horizontal direction, the central axis of the core mold 4, the central axis of the frame 2, and the central axis of the motor 7 are aligned with one another.

Figure 3:
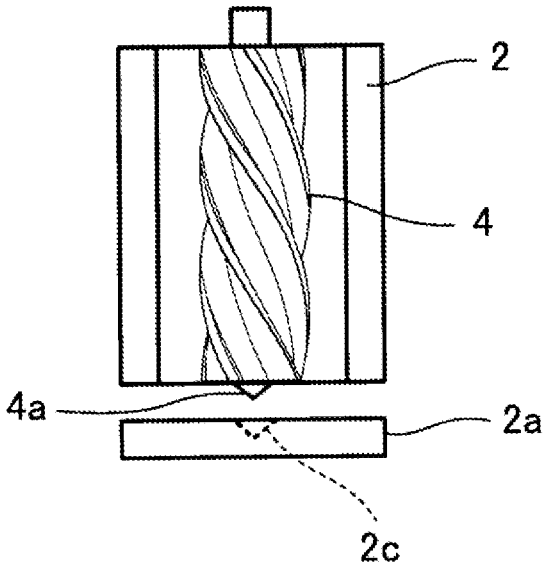
FIG. 3 A side view of the frame.

When the shaft 4*a* of the core mold 4 has a conical end as shown in FIG. 3 which is a side view of the frame 2, a conical concave portion 2*c* may be provided in the bottom plate 2*a* of the frame 2 so that the both can be fitted to each other.

In such a configuration, as shown in FIG. 1, the frame 2 whose top is open is first mounted on the frame bed 3, and the side plates 3*a* are brought into contact with the side surfaces of the frame 2. Thus, the frame 2 is fixed onto the frame bed 3. On this occasion, the central axis of the frame 2 is aligned with the central axis of the motor 7.

Next, the core mold 4 is disposed along the vertical direction inside the frame 2, the shaft 4*a* of the core mold 4 is retained by the shaft retainer 5. On this occasion, the shaft 4*a* of the core mold 4 is fitted into the concave portion 2*b* to align the central axis of the core mold 4 with the central axis of the frame 2. Thus, the central axis of the core mold 4 is aligned with the central axis of the motor 7. Accordingly, when the frame 2 is rotated by the motor 7, the friction coefficient of friction force generated between the core 15 and the core mold 4 can be minimized. As a result, the core 15 can be rotated so stably that the core 15 can be molded without internal damage and with a reduced variation in shape.

Next, the self-hardening sand is charged into the frame 2 from the top of the frame 2. Each side surface of the frame 2 is hit by a hammer to charge the self-hardening sand into the frame 2 along the axial direction of the core mold 4 while vibrating the self-hardening sand.

After a predetermined curing time has passed, the frame bed 3 is rotated in the horizontal direction by the motor 7 to thereby rotate the frame 2 in the horizontal direction. The frame 2 is rotated while pulling the shaft retainer 5 by the pulling unit 13 in the upper direction with the tension not lower than the load of the core mold 4. When the frame 2 is rotated not to rotate the core mold 4, the core mold 4 having a screw shape is extracted from the core 15 along the vertical direction. Here, the rotating direction of the frame 2 is set so that the core mold 4 can be extracted in the upper direction. Thus, the core mold 4 is extracted in the upper direction from the core 15. During the extraction, the shaft retainer 5 moves in the upper direction along the rail 12, and the wire 14 is wound up by the pulling unit 13. When the core mold 4 is completely extracted from the core 15 in this manner, the core mold 4 in a state of being suspended by the shaft retainer 5 stops above the core 15.

In this manner, the core mold 4 is disposed along the vertical direction within the frame 2, and the self-hardening sand is then charged into the frame 2 from the top of the frame 2, and cured. The core mold 4 is extracted in the vertical direction from the core 15 formed of the cured self-hardening sand. Since the core mold 4 disposed along the vertical direction is extracted in the vertical direction, it is not necessary to change the posture of the frame 2. Accordingly, the motor 7 can be axially aligned with the core mold 4 in advance. As a result, workability can be improved. In addition, since the self-hardening sand is charged into the frame 2 from the top of the frame 2, the self-hardening sand can be sufficiently charged into a valley portion of the core mold 4 having a twisted shape. As a result, the core 15 can be molded with an excellent shape.

In addition, the frame 2 is rotated in the horizontal direction so that the core mold 4 is extracted in the vertical direction from the core 15. If the core mold 4 is rotated in the horizontal direction, the core mold 4 will move in the vertical direction relatively to the core 15. Thus, the motor for rotating the core mold 4 must be moved in the vertical direction, and a mechanism for moving the motor or a space for retracting the motor must be provided. Thus, the apparatus will be complicated and increased in size. Therefore, the frame 2 is rotated in the horizontal direction so that the core mold 4 can be extracted from the core 15 without moving the frame 2 in the vertical direction. Thus, it is not necessary to provide any mechanism for moving the motor 7 or any space for retracting the motor 7. It is therefore possible to simplify and miniaturize the apparatus.

In addition, the core mold 4 is extracted in the upper direction from the core 15 while pulling the core mold 4 in the upper direction with the tension not lower than the load of the core mold 4. Thus, the core mold 4 is prevented from moving downward during the extraction of the core mold 4 or after the extraction of the core mold 4. It is therefore possible to prevent the load of the core mold 4 from applying to the core 15 to thereby deform the core 15 axially.

Further, since the central axis of the core mold 4 is aligned with the central axis of the frame 2 when the core mold 4 is disposed within the frame 2, the central axis of the core mold 4, the central axis of the frame 2 and the central axis of the motor 7 can be aligned with one another when the core mold 4 and the frame 2 are rotated relatively to each other.

[Modification]

Figure 4:
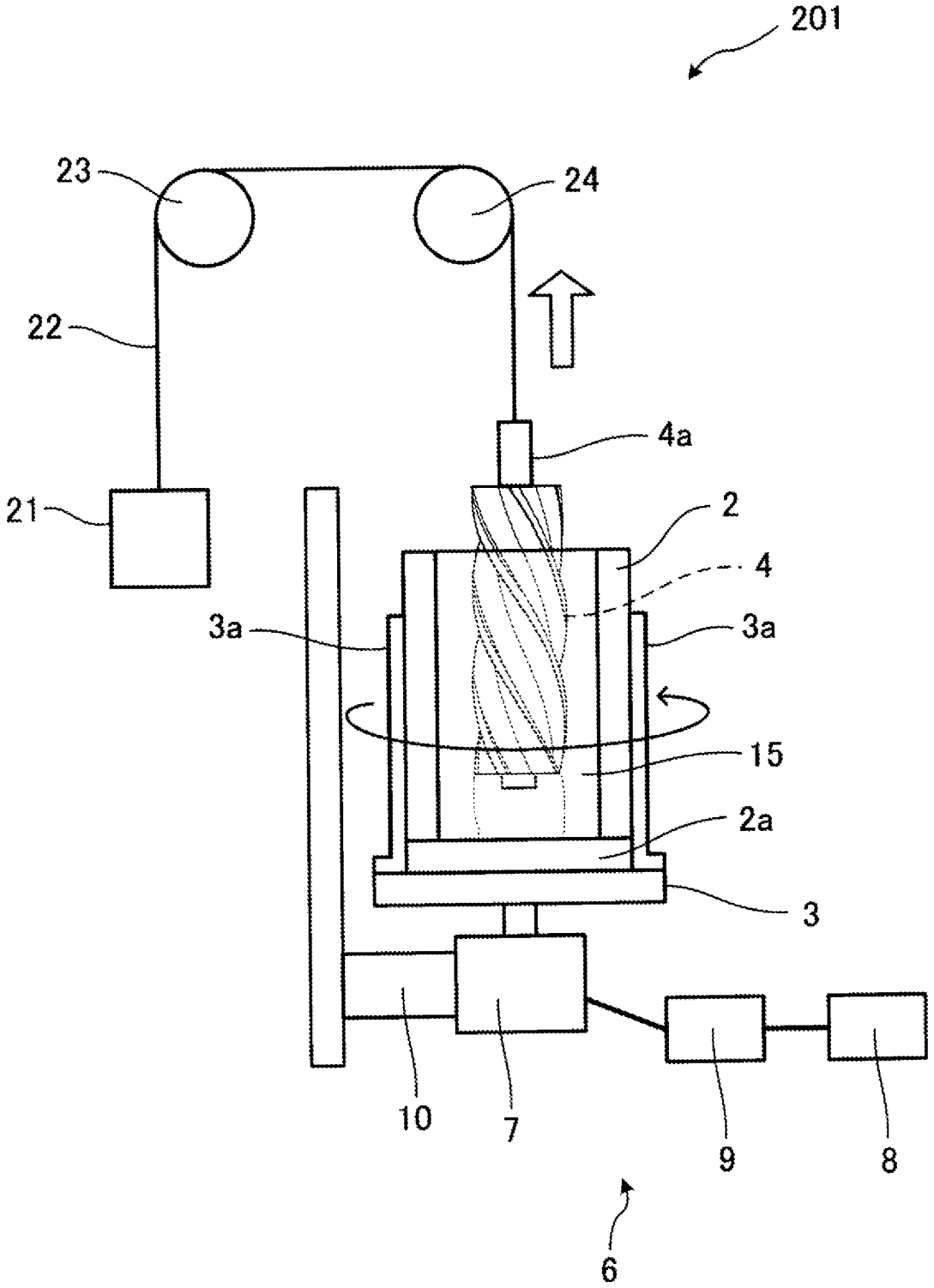
FIG. 4 A side view showing a configuration of a core molding apparatus.

It is not limited to the configuration in which the core mold 4 is pulled in the upper direction by the pulling unit 13 with the tension not lower than the load of the core mold 4. As shown in FIG. 4 which is a side view thereof, it may have a configuration in which a core molding apparatus 201 includes a weight 21 connected to a shaft 4*a* of a core mold 4 through a wire 22, and the wire 22 is supported by pulleys 23 and 24 so that the tension caused by the weight 21 can be applied to the shaft 4*a* of the core mold 4. The tension caused by the weight 21 is equal to or higher than the total load of the core mold 4 and the wire 22. Even in such a configuration, the core mold 4 can be prevented from moving downward during the extraction of the core mold 4 or after the extraction of the core mold 4.

(Effect)

As described above, in the core molding method and the core molding apparatus in the embodiment, the core mold 4 is disposed along the vertical direction within the frame 2, and the self-hardening sand is then charged into the frame 2 from the top of the frame 2, and cured. Then the core mold 4 is extracted in the vertical direction from the core 15 formed of the cured self-hardening sand. Since the core mold 4 disposed along the vertical direction is extracted in the vertical direction, it is not necessary to change the posture of the frame 2. Accordingly, the motor 7 can be axially aligned with the core mold 4 in advance. As a result, workability can be improved. In addition, since the self-hardening sand is charged into the frame 2 from the top of the frame 2, the self-hardening sand can be sufficiently charged into a valley portion of the core mold 4 having a twisted shape. As a result, the core 15 can be molded with an excellent shape.

In addition, the frame 2 is rotated in the horizontal direction so that the core mold 4 is extracted in the vertical direction from the core 15. If the core mold 4 is rotated in the horizontal direction, the core mold 4 will move in the vertical direction relatively to the core 15. Thus, the motor for rotating the core mold 4 must be moved in the vertical direction, and a mechanism for moving the motor or a space for retracting the motor must be provided. Thus, the apparatus will be complicated and increased in size. Therefore, the frame 2 is rotated in the horizontal direction so that the core mold 4 can be extracted from the core 15 without moving the frame 2 in the vertical direction. Thus, it is not necessary to provide any mechanism for moving the motor 7 or any space for retracting the motor 7. It is therefore possible to simplify and miniaturize the apparatus.

In addition, the core mold 4 is extracted in the upper direction from the core 15 while pulling the core mold 4 in the upper direction with the tension not lower than the load of the core mold 4. Thus, the core mold 4 is prevented from moving downward during the extraction of the core mold 4 or after the extraction of the core mold 4. It is therefore possible to prevent the load of the core mold 4 from applying to the core 15 to thereby deform the core 15 axially.

Further, since the central axis of the core mold 4 is aligned with the central axis of the frame 2 when the core mold 4 is disposed within the frame 2, the central axis of the core mold 4, the central axis of the frame 2 and the central axis of the motor 7 can be aligned with one another when the core mold 4 and the frame 2 are rotated relatively to each other.

[Second Embodiment]

(Core Molding Method)

Next, a core molding method in the second embodiment of the present invention will be described. Constituent elements which are the same as the aforementioned constituent elements are referenced correspondingly, and description thereof will be omitted. The core molding method in this embodiment is the same as the core molding method in the first embodiment, except that in the curing step, after a large amount of the self-hardening sand enough to overflow from a frame is charged into the frame, the self-hardening sand overflowing from the frame is removed to flatten the upper end surface of the self-hardening sand within the frame.

(Curing Step)

When the self-hardening sand is charged into the frame from the top of the frame, the self-hardening sand within the frame may be insufficient due to a change in bulk density or the like of the self-hardening sand. Therefore, in the curing step, a large amount of the self-hardening sand enough to overflow from the frame is charged into the frame. Although there is no fear that the self-hardening sand is insufficient, the upper end surface of the core may be not flat when the self-hardening sand overflowing from the frame is cured as it is. Thus, there is a fear that a shape error may occur when the core is placed in a main mold. Therefore, before the mold extracting step is performed, the self-hardening sand overflowing from the frame is removed to flatten the upper end surface of the self-hardening sand within the frame. As a result, the upper end surface of the core can be formed with high accuracy.

It can be considered that a proper amount of the self-hardening sand to be charged is grasped in advance, and the proper amount is measured and charged into the frame. However, an unnecessary part or a risk of insufficiency may occur due to a change in bulk density or the like of the self-hardening sand. It is therefore more reasonable that a large amount of the self-hardening sand enough to overflow from the frame is charged into the frame, and the self-hardening sand overflowing from the frame is then removed.

The unnecessary self-hardening sand may be removed during the curing of the self-hardening sand or after the curing of the self-hardening sand as long as the mold extracting step has not been performed yet. If the upper end surface of the core is taken care after the extraction of the core mold, a locally thinned part such as a part around a hole formed after the extraction of the core mold may be damaged easily. Therefore, the upper end surface of the self-hardening sand within the frame is flattened before the extraction of the core mold. In addition, in order to avoid damage on the self-hardening sand with a slight external force, it is preferable that the upper end surface of the self-hardening sand within the frame is flattened after the self-hardening sand has some degree of strength.

The unnecessary self-hardening sand is removed by a removal unit whose lower end abuts against the upper end surface of the core mold disposed within the frame. When the removal unit is rotated around the axis of the core mold, the self-hardening sand overflowing from the frame is scraped off by a spatulate member included in the removal unit.

(Core Molding Apparatus)

Figure 5:
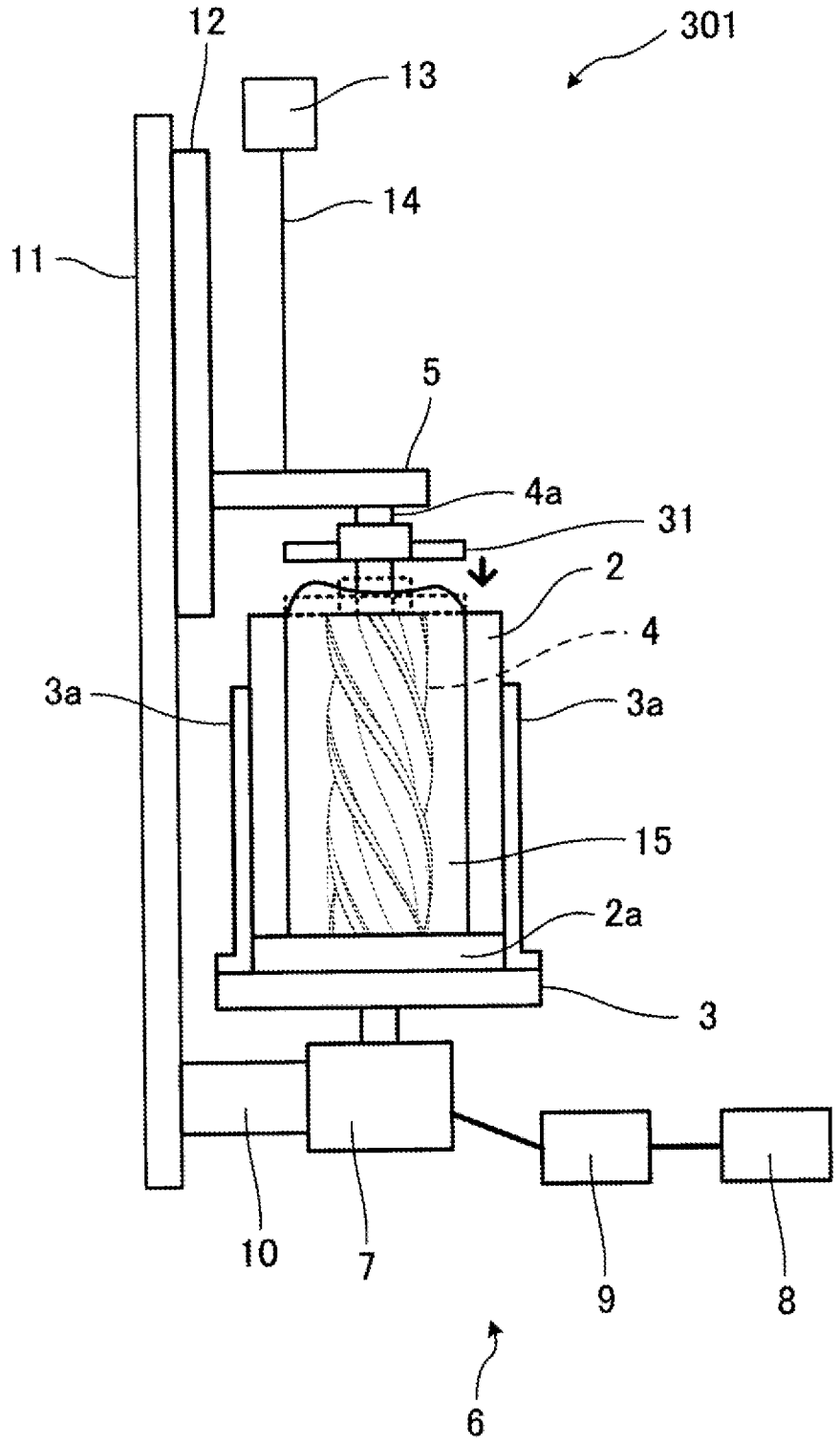
FIG. 5 A side view showing a configuration of a core molding apparatus.

In a core molding apparatus in the second embodiment of the present invention, the aforementioned core molding method is performed. The core molding apparatus 301 includes a removal unit 31 as shown in FIG. 5 which is a side view thereof. A large amount of the self-hardening sand enough to overflow from the frame 2 is charged into the frame 2.

The removal unit 31 is attached to the shaft 4*a* of the core mold 4. The removal unit 31 can rotate around the shaft 4*a* of the core mold 4.

Figure 6A:
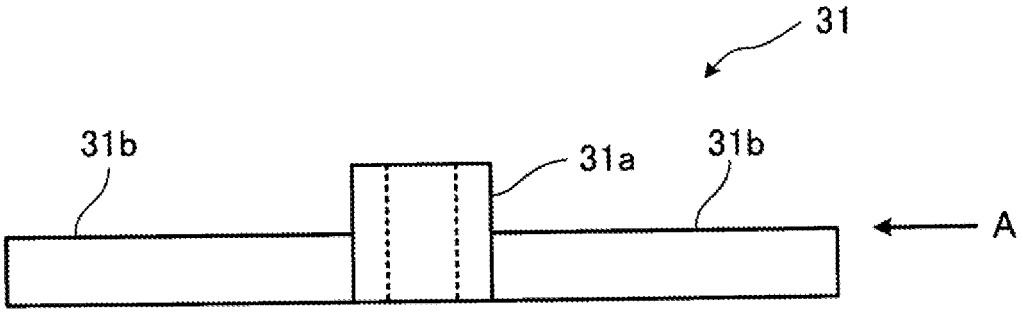
FIG. 6A A side view of a removal unit.
Figure 6B:
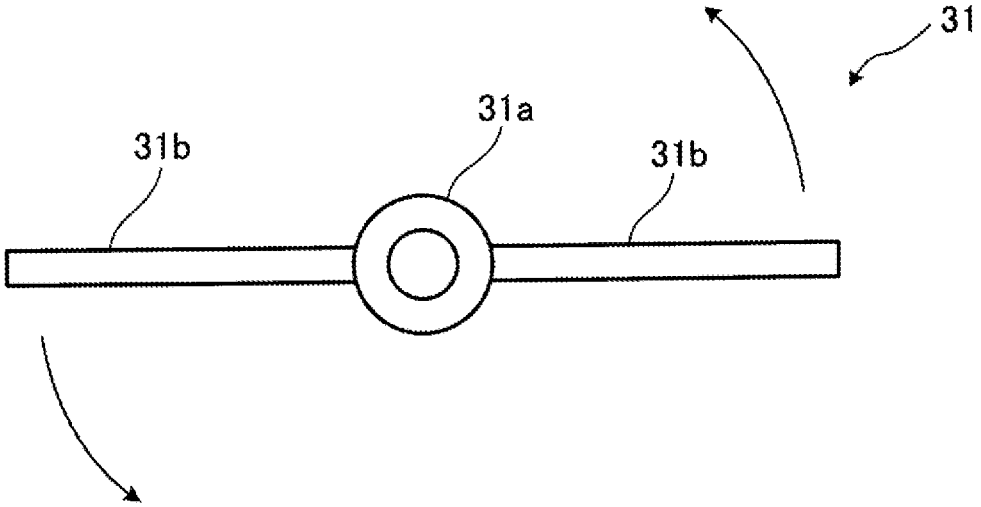
FIG. 6B A top view of the removal unit.

As shown in FIG. 6A which is a side view of the removal unit 31 and FIG. 6B which is a top view of the removal unit 31, the removal unit 31 includes a cylindrical member 31*a* having a cylindrical shape, and removal members 31*b* each having a spatulate shape. The shaft 4*a* of the core mold 4 is inserted into the cylindrical member 31*a*. The removal members 31*b* are attached to the outer circumferential surface of the cylindrical member 31*a*. The inner diameter of the cylindrical member 31*a* is made larger than the outer diameter of the shaft 4*a* of the core mold 4. The removal members 31*b* scrape off the self-hardening sand overflowing from the frame 2 when the removal unit 31 is rotated. The number of removal members 31*b* is two, which are provided at an interval of 180 degrees in the circumferential direction of the cylindrical member 31*a*. The length of each of the removal members 31*b* is set so that an end of the removal member 31*b* is located inside the frame 2.

Figure 7:
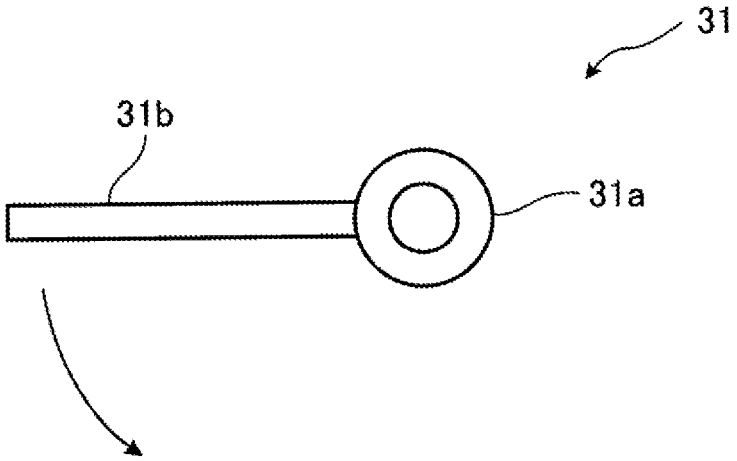
FIG. 7 A top view of the removal unit.
Figure 8:
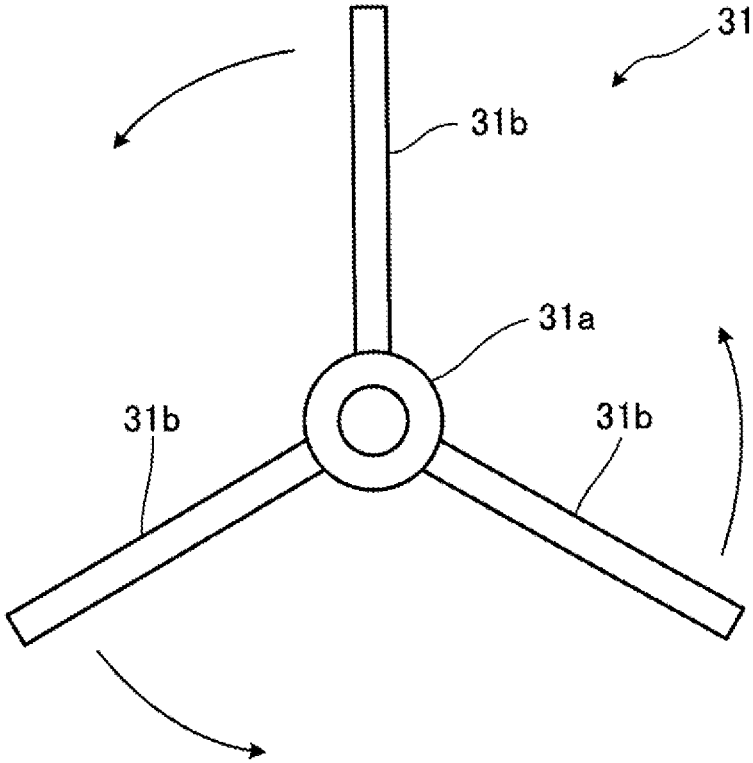
FIG. 8 A top view of the removal unit.

As shown in FIG. 7 which is a top view of the removal unit 31, the number of removal members 31*b* may be one. Alternatively, as shown in FIG. 8 which is a top view of the removal unit 31, the number of removal members 31*b* may be three, which are, for example, provided at intervals of 120 degrees in the circumferential direction of the cylindrical member 31*a*. Not to say, four or more removal members 31*b* may be provided.

Figure 9A:
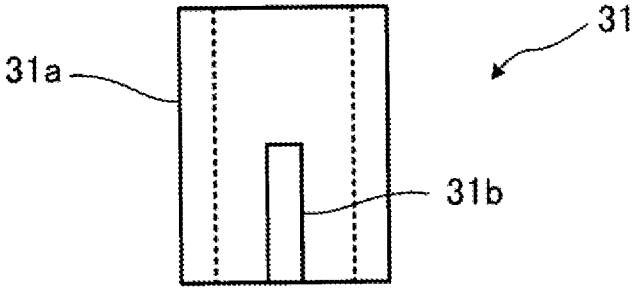
FIG. 9A A side view viewed from a direction A of FIG. 6A.
Figure 9B:
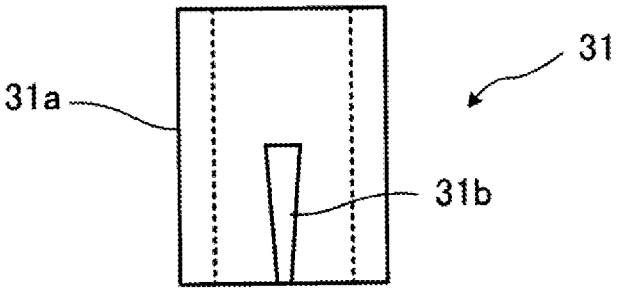
FIG. 9B A side view viewed from the direction A of FIG. 6A.
Figure 9C:
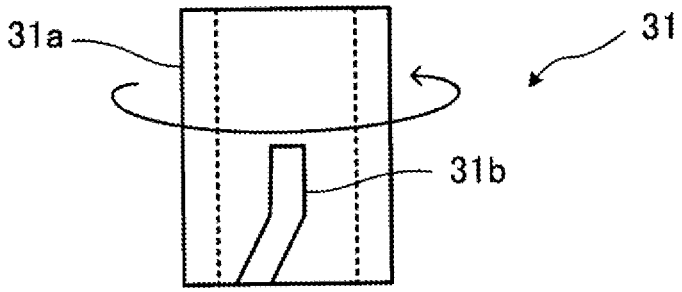
FIG. 9C A side view viewed from the direction A of FIG. 6A.

As shown in FIG. 9A which is a side view viewed from a direction A of FIG. 6A, each removal member 31*b* has a uniform thickness from its upper end to its lower end. As shown in FIG. 9B which is a side view viewed from the direction A of FIG. 6A, the thickness of the removal member 31*b* may be reduced gradually from the upper end toward the lower end. When the thickness on the lower end side is reduced, the ability to scrape off the self-hardening sand can be improved. Alternatively, as shown in FIG. 9C which is a side view viewed from the direction A of FIG. 6A, a lower end portion of the removal member 31*b* may be inclined or curved on the opposite side to the rotating direction (arrow direction). Even in this manner, the ability to scrape off the self-hardening sand can be improved.

As shown by the solid line in FIG. 5, the removal unit 31 is retracted above the frame 2 not to interfere with the charging of the self-hardening sand when the self-hardening sand is charged. After the self-hardening sand is charged, the removal unit 31 is disposed so that the lower end of the removal unit 31 abuts against the upper end surface of the core mold 4, as shown by the broken line in FIG. 5. When the removal unit 31 is rotated manually, the self-hardening sand overflowing from the frame 2 is scraped off by the removal members 31*b*. The removal unit 31 may have a configuration in which the removal unit 31 is removed from the shaft 4*a* of the core mold 4 during charging of the self-hardening sand, and attached to the shaft 4*a* of the core mold 4 after charging of the self-hardening sand.

When the self-hardening sand is charged into the frame 2 from the top of the frame 2, the self-hardening sand within the frame 2 may be insufficient due to a change in bulk density or the like of the self-hardening sand. Therefore, in this embodiment, a large amount of the self-hardening sand enough to overflow from the frame 2 is charged into the frame 2. Thus, there is no fear that the self-hardening sand is insufficient. However, the upper end surface of the core 15 may be not flat when the self-hardening sand overflowing from the frame 2 is cured as it is. Thus, there is a fear that a shape error may occur when the core 15 is placed in a main mold. Therefore, before the core mold 4 is extracted, the self-hardening sand overflowing from the frame 2 is removed to flatten the upper end surface of the self-hardening sand within the frame 2. As a result, the upper end surface of the core 15 can be formed with high accuracy.

In addition, the removal unit 31 is rotated around the shaft 4*a* of the core mold 4 so that the self-hardening sand overflowing from the frame 2 is scraped off by the removal members 31*b* included in the removal unit 31. Thus, the upper end surface of the self-hardening sand within the frame 2 can be flattened suitably.

Figure 10:
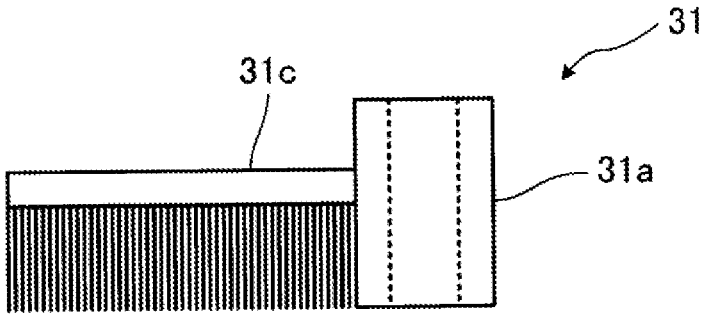
FIG. 10 A side view of the removal unit.

As shown in FIG. 10 which is a side view of the removal unit 31, the removal unit 31 may have a brush 31*c* in place of each spatulate removal member 31*b*. When the self-hardening sand overflowing from the frame 2 is scraped off by a plurality of bristles of the brush 31*c*, the upper end surface of the self-hardening sand within the frame 2 can be flattened suitably. In addition, the brush 31*c* can reduce a load on the self-hardening sand within the frame 2.

Figure 11A:
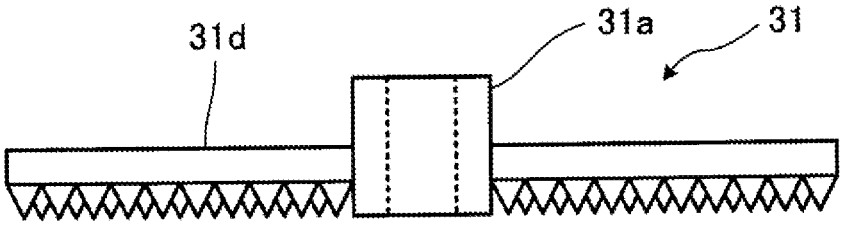
FIG. 11A A side view of the removal unit.
Figure 11B:
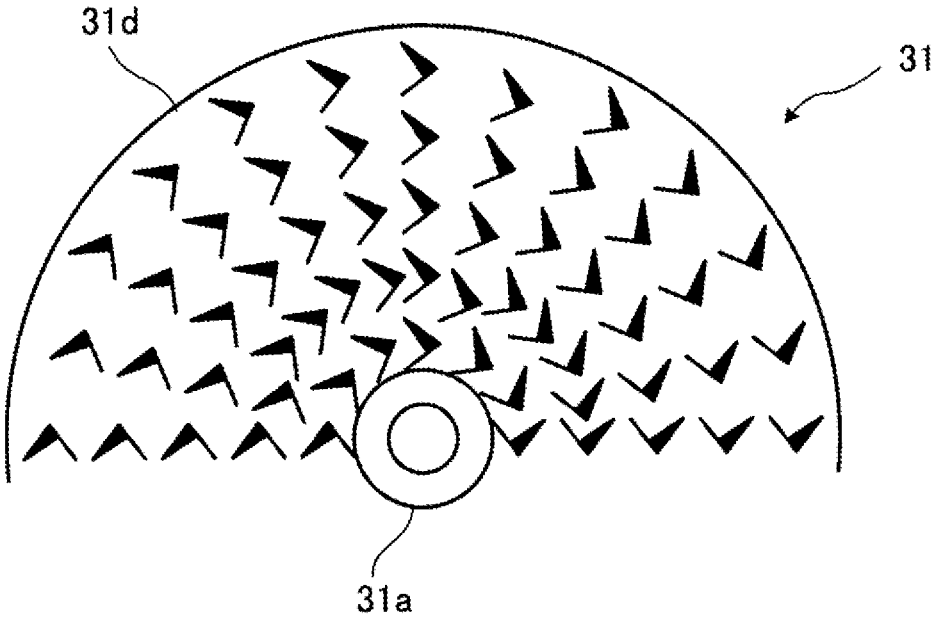
FIG. 11B A top view of the removal unit.

In addition, as shown in FIG. 11A which is a side view of the removal unit 31 and FIG. 11B which is a top view of the removal unit 31, the removal unit 31 may include a disc-shaped plate member 31*d*, and a plurality of notch portions may be formed in the plate member 31*d*. The plate member 31*d* is notched so that each notch portion is folded and located with its front end down. Therefore, at places where the notch portions are formed, holes are made in the plate member 31*d*. The self-hardening sand scraped off by the notch portions moves to the upper surface of the plate member 31*d* through the holes so that the self-hardening sand can be removed manually from the upper surface of the plate member 31*d*. Even in such a configuration, the upper end surface of the self-hardening sand within the frame 2 can be flattened suitably. The shape of the plate member 31*d* is not limited to the disc shape, but may be a fan shape.

(Effect)

As described above, in the core molding method and the core molding apparatus in the embodiment, a large amount of the self-hardening sand enough to overflow from the frame 2 is charged into the frame 2, and the self-hardening sand overflowing from the frame 2 is then removed by the removal unit 31 whose lower end abuts against the upper end surface of the core mold 4 disposed within the frame 2. Thus, the upper end surface of the self-hardening sand within the frame 2 is flattened. When the self-hardening sand is charged into the frame 2 from the top of the frame 2, the self-hardening sand may be insufficient due to a change in bulk density or the like of the self-hardening sand. Therefore, a large amount of the self-hardening sand enough to overflow from the frame 2 is charged into the frame 2. Thus, there is no fear that the self-hardening sand is insufficient. However, the upper end surface of the core 15 may be not flat when the self-hardening sand overflowing from the frame 2 is cured as it is. Thus, there is a fear that a shape error may occur when the core 15 is placed in a main mold. Therefore, before the core mold 4 is extracted, the self-hardening sand overflowing from the frame 2 is removed to flatten the upper end surface of the self-hardening sand within the frame 2. As a result, the upper end surface of the core 15 can be formed with high accuracy.

In addition, the removal unit 31 is rotated around the shaft 4*a* of the core mold 4 so that the self-hardening sand overflowing from the frame 2 is scraped off by the spatulate removal members 31*b* included in the removal unit 31. Thus, the upper end surface of the self-hardening sand within the frame 2 can be flattened suitably.

The embodiments of the present invention which have been described above illustrate specific examples merely. The embodiments do not limit the present invention particularly, but specific configurations or the like can be changed in design suitably. In addition, in the operations and effects described in the embodiments of the invention, most preferred operations and effects produced by the present invention are merely described. Operations and effects by the present invention are not limited to those in the embodiments of the present invention.

The present application is based on Japanese patent application No. 2015-240504 filed on Dec. 9, 2015, and Japanese patent application No. 2016-098736 filed on May 17, 2016, the contents of which are incorporated herein by reference.

DESCRIPTION OF REFERENCE NUMERALS AND SIGNS

1, 201, 301 Core molding apparatus
2 Frame
2*a* Bottom plate
2*b*, 2*c* Concave portion
3 Frame bed
3*a* Side plate
4 Core mold
4*a* Shaft
5 Shaft retainer
6 Rotary driving unit
7 Motor
8 Power source
9 Inverter
10 Motor fixture
11 Stand
12 Rail
13 Pulling unit
14 Wire
15 Core
21 Weight
22 Wire
23, 24 Pulley

The invention claimed is:

1. A core molding method for molding a core having a twisted shape by use of a core mold, the core molding method comprising:

a curing step in which after the core mold is disposed along a vertical direction within a frame whose top is open, a self-hardening sand formed of a kneaded mixture of a sand, a resin and a curing agent is charged into the frame from the top of the frame, and then cured; and a mold extracting step in which the core mold is extracted in the vertical direction from the core formed of the cured self-hardening sand while rotating the frame in a horizontal direction around an axis of the core mold.

2. The core molding method according to claim 1, wherein in the mold extracting step, the frame is rotated in the horizontal direction while pulling the core mold in an upper direction with a tension not lower than a load of the core mold, so that the core mold is extracted in the upper direction from the core.

3. The core molding method according to claim 2, wherein in the curing step, a central axis of the core mold is aligned with a central axis of the frame when the core mold is disposed within the frame.

4. The core molding method according to claim 1, wherein in the curing step, a central axis of the core mold is aligned with a central axis of the frame when the core mold is disposed within the frame.

5. The core molding method according to claim 1, wherein in the curing step, after a large amount of the self-hardening sand enough to overflow from the frame is charged into the frame, the self-hardening sand overflowing from the frame is removed by a removal unit whose lower end abuts against an upper end surface of the core mold disposed within the frame, thereby flattening an upper end surface of the self-hardening sand within the frame.

6. The core molding method according to claim 5, wherein the removal unit is rotated around an axis of the core mold so that the self-hardening sand overflowing from the frame is scraped off by a spatulate member included in the removal unit.

* * * * *